US006802297B2

(12) United States Patent
Braun et al.

(10) Patent No.: US 6,802,297 B2
(45) Date of Patent: Oct. 12, 2004

(54) FUEL RAIL DAMPING DEVICE

(75) Inventors: Charles W. Braun, Livonia, NY (US); Jay K. Sofianek, Webster, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/351,700

(22) Filed: Jan. 27, 2003

(65) Prior Publication Data

US 2004/0144367 A1 Jul. 29, 2004

(51) Int. Cl.[7] ..... F02M 41/00
(52) U.S. Cl. ..... 123/456; 123/447
(58) Field of Search ..... 123/456, 447, 123/463, 465; 138/26, 30

(56) References Cited

U.S. PATENT DOCUMENTS 5,456,233 A * 10/1995 Felhofer ..... 123/447
5,575,262 A * 11/1996 Rohde ..... 123/467
5,579,739 A * 12/1996 Tuckey et al. ..... 123/467
5,617,827 A * 4/1997 Eshleman et al. ..... 123/456
5,896,843 A * 4/1999 Lorraine ..... 123/467
6,513,500 B2 2/2003 Braun et al.
6,675,657 B1 1/2004 KalTsounis et al. ..... 73/730

FOREIGN PATENT DOCUMENTS

JP 11351090 12/1999

* cited by examiner

*Primary Examiner*—Mahmoud Gimie
(74) *Attorney, Agent, or Firm*—Patrick M. Griffin

(57) ABSTRACT

A fuel rail damper, which includes a hollow member having a first end and a second end, and at least one active portion. The hollow member being open to atmospheric pressure, thereby defining a chamber in conjunction with the at least one active portion.

15 Claims, 4 Drawing Sheets

FUEL RAIL DAMPING DEVICE

TECHNICAL FIELD

The present invention relates to fuel rail assemblies and, more particularly, to fuel rail damping devices wherein the damper is open to atmosphere.

BACKGROUND OF THE INVENTION

Many modern automobiles incorporate fuel injected engines which require a high-pressure fuel feed upstream of the fuel injectors. The fuel injection system incorporates a plurality of injectors that deliver fuel to the inlet ports of the engine. The injectors are mounted in a fuel rail that supplies high-pressure fuel to the inlet side of the injectors. Most fuel injected engines use electromagnetic fuel injectors, one injector per cylinder, which deliver fuel in metered pulses that are timed to provide the amount of fuel, needed in accordance with the operating condition of the engine.

The cyclic operation of the electromagnetic injectors induce pressure pulsations in the fuel rail which may have a detrimental affect on the operation of the fuel metering system. To reduce the effect of the pressure pulsations, automotive designers have incorporated dampers into the fuel system. Damping systems known in the art add compliance to the fuel injection system by adding devices such as internal rail damping systems or external rail damping systems.

One type of external damping system incorporates a spring diaphragm device; an o-ring sealed interface to the rail, a retaining clip, as well as multiple stamped parts that form the interface to the rail. Internal damping systems that provide a closed and atmospherically pressurized vessel within the fuel rail have fewer parts than an external damping system. However, in the conventional internal damping system, the damper must be assembled into the rail after the components of the rail are brazed together since the extreme temperatures in the braze furnace would cause the air trapped in the damper to expand and thereby cause permanent deformation of the damper walls and render the damper ineffective. The necessary post-braze assembly operation of the damper to the fuel rail adds labor, and additional parts including an o-ring sealed end plug and a retaining clip. This may also increase costs and reduce reliability of the fuel rail assembly. U.S. Pat. No. 5,617,827 issued to Eshleman et al. on Apr. 8, 1997, the disclosure of which is incorporated herein by reference, discloses a fuel rail that includes a conventional internal fuel rail damper.

What is needed in the art is an internal damper which can endure the temperatures of the brazing operation and therefore can be assembled into the fuel rail before the brazing process is completed.

SUMMARY OF THE INVENTION

A fuel rail damper which includes a hollow member having a first end and a second end, and at least one active portion. At least one of the first and second ends being open to atmospheric pressure and extending outside the fuel rail to thereby define a chamber in conjunction with the active portion.

BRIEF DESCRIPTION OF THE DRAWINGS

These and other features and advantages of the invention will be more fully understood and appreciated from the following description of certain exemplary embodiments of the invention taken together with the accompanying drawings, in which.

DESCRIPTION OF THE PREFERRED EMBODIMENTS

Generally, and as will be more particularly described hereinafter, the fuel rail damper of the present invention is installed within a fuel rail of an internal combustion engine. The fuel rail damper acts to reduce pressure pulsations that occur within the fuel rail as a result of the operation of fuel injectors in fluid communication with the fuel rail.

Figure 11:
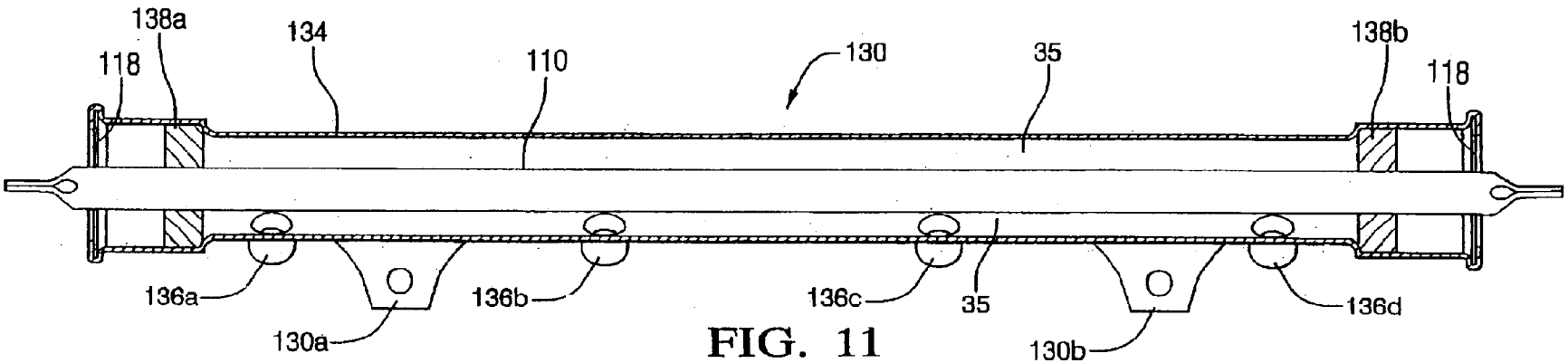
FIG. 11 is a cut-away view of the fuel rail in FIG. 10 wherein both ends of the fuel rail damper are closed.

More specifically, the concept of the present invention is to allow one or more ends of the damper to protrude through the end cap of the fuel rail and allow that end to reference the atmosphere, and hence, atmospheric pressure. The flexible walls of the damper are then exposed to fuel pressure on one side and air at atmospheric pressure on the other. However, since the air is not trapped inside the damper as a sealed vessel, as in the prior art, the air's expansion due to heating during brazing of the fuel rail, does not exert a force on the damping surfaces to permanently deform the damper walls. The open end or ends of the rail may be sealed after the brazing operation by weld or other means as best seen in FIG. 11, or simply left open.

Figure 1:
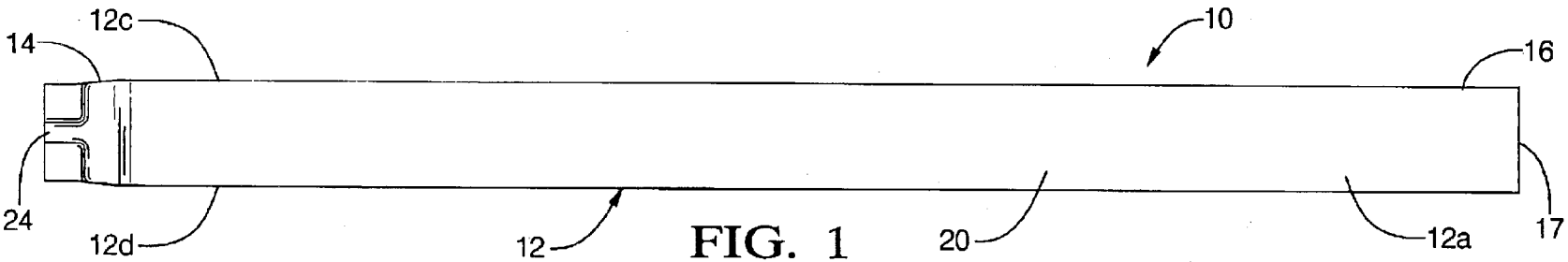
FIG. 1 is a side view of a first embodiment of a fuel rail damper of the present invention.
Figure 2:
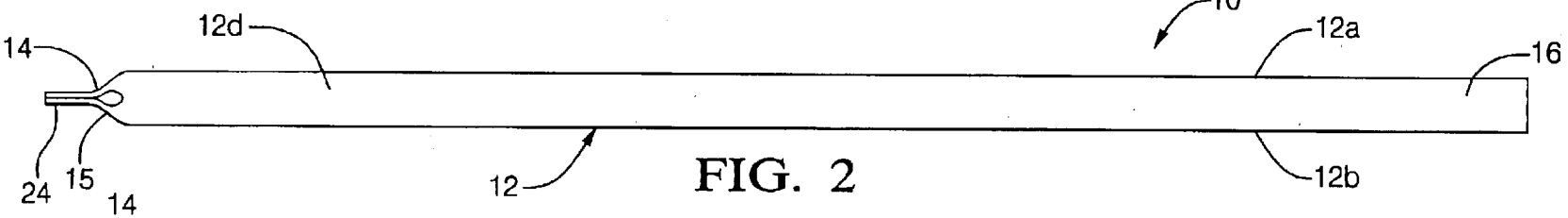
FIG. 2 is a top view of the fuel rail damper of FIG. 1.
Figure 5:
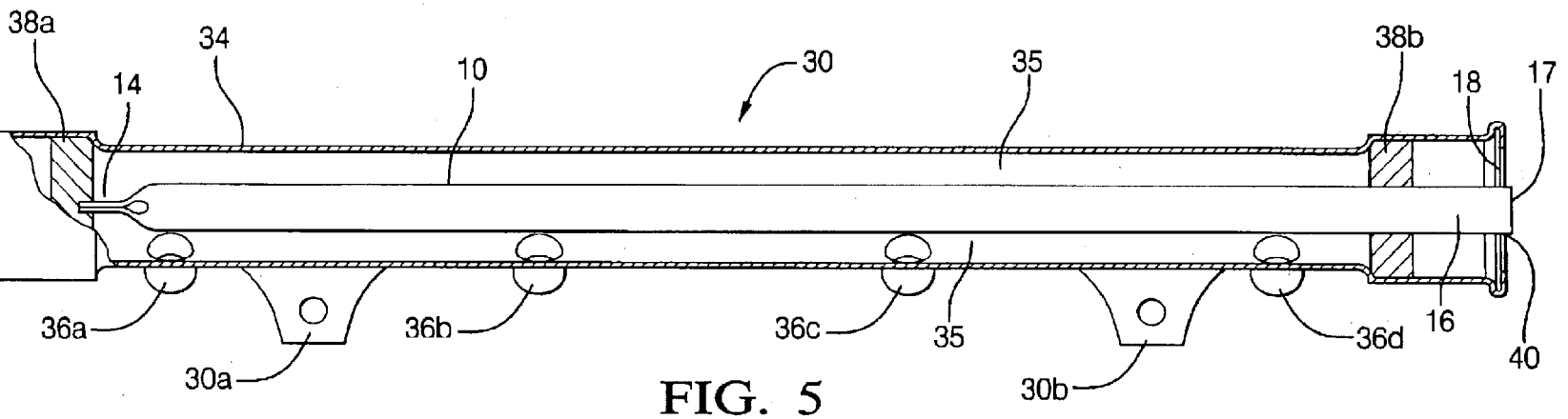
FIG. 5 is a cut-away view of a fuel rail having the fuel rail damper of FIG. 1 operably installed therein.
Figure 6:
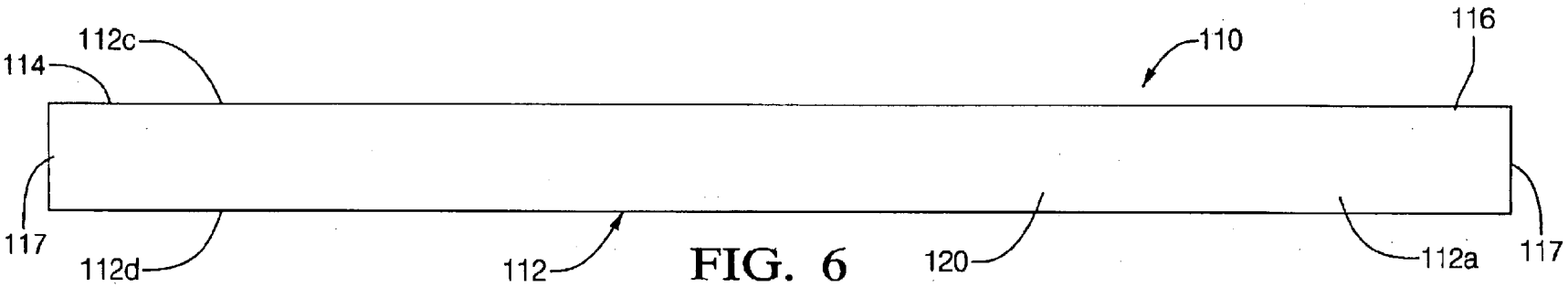
FIG. 6 is a side view of a second embodiment of a fuel rail damper of the present invention.
Figure 7:
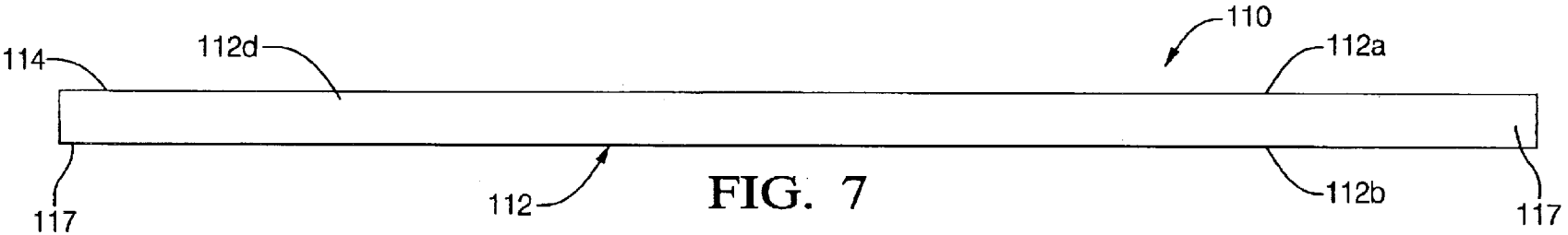
FIG. 7 is a is a top view of the fuel rail damper of FIG. 6.
Figure 8:
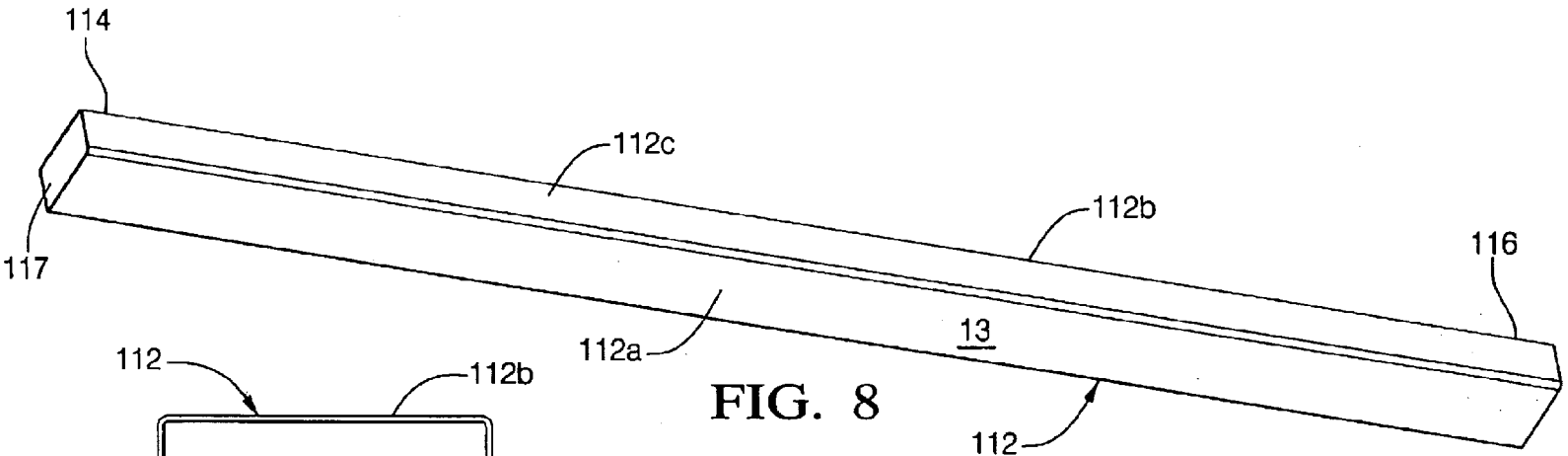
FIG. 8 is a perspective view of the fuel rail damper of FIG. 6.
Figure 9:
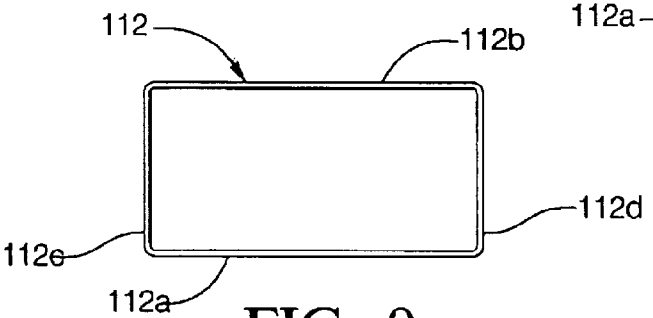
FIG. 9 is an end view of FIG. 6.

Referring now to the drawings, and particularly to FIGS. 1 and 2, there is shown a first embodiment of the invention where damper 10 is generally and elongate member and one end of damper 10 is closed. Fuel rail damper 10 includes a hollow member 12 having first end 14 and second end 16. End 14 is sealed in a fluid tight manner, such as, for example, by welding, brazing or other suitable means, which may include a separately formed cap (not shown) to thereby define a plenum 20 having a closed end 15 and an open end 17. Hollow member 12 is, in this embodiment substantially rectangular in cross-section. Hollow member 12 includes walls 12*a*, 12*b* and sides 12*c*, 12*d*. Walls 12*a* and 12*b* are relatively wide compared to sides 12*c*, 12*d*. At least one of walls 12*a*, 12*b* include active portion 13 (one shown) of fuel rail damper 10. Active portion(s) 13 act to absorb and slow pressure pulsations occurring in the fuel rail 30 (FIG. 5). Hollow member 12 is constructed of, for example, stainless steel, low carbon steel, aluminum, or other suitable material that is substantially impervious to gasoline and/or fuel vapor.

Hollow member 12 is a one-piece fabricated member. Some possible ways of fabricating hollow member 12 include; a rolled weld process, a rolled weld and mandrel drawn process, or extrusion process, of flat stock or round tubing of the raw materials referred to above.

Figure 3:
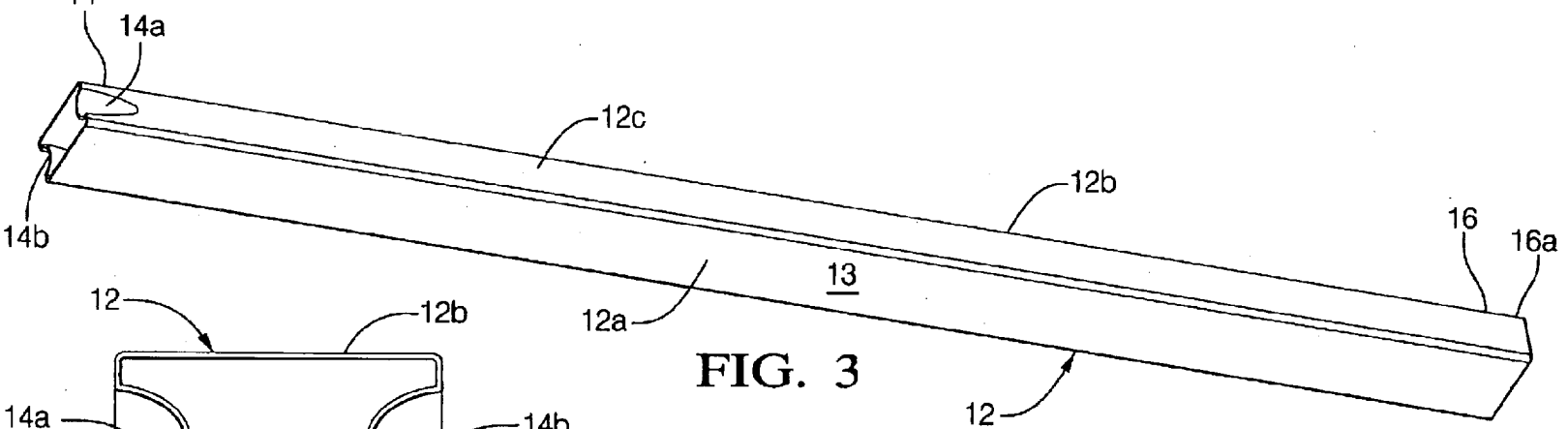
FIG. 3 is a perspective view of the fuel rail damper of FIG. 1 prior to closing the end thereof.
Figure 4:
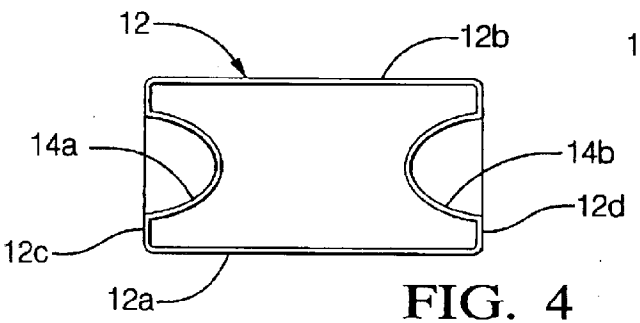
FIG. 4 is an end view of FIG. 3.

As shown in FIGS. 3 and 4, hollow member 12 may be provided at first end 14 with recesses 14*a*, 14*b*, formed, for example, by stamping or rolling, in sides 12*c* and 12*d*. Each of recesses 14*a*, 14*b* are generally wedge-shaped in that the width increases with proximity to first end 14 (see FIG. 3). In cross-section, each of top and bottom recesses 14*a*, 14*b* are generally parabolic or conical in shape (see FIG. 4).

As best shown in FIG. 2, first end 14 pressed together or flattened, for example, by stamping, in the region proximate top and bottom recesses 14*a*, 14*b*. The pressing or stamping force is applied in a direction that is generally perpendicular to walls 12*a* and 12*b*, and closes the first end 14. Thereafter, first end 14 is fastened together and sealed, for example, by welding, brazing, or other suitable means. Sealing first end 14 of the area defined by hollow member 12 forms a chamber or plenum 20 within hollow member 12. The flattened or pressed portion of first end 14 forms tab 24 (FIGS. 1 and 2) which can also be used for operably mounting fuel rail damper 10 within fuel rail 30.

Referring now to FIG. 5, there is shown a first embodiment of fuel rail damper 10 of the present invention installed in fuel rail 30. Fuel rail 30 includes brackets 30*a*, 30*b* by which fuel rail 30 is operably installed, such as, for example, bolted to internal combustion engine (not shown). Fuel rail 30 further includes an elongate tubular member 34, which defines a passageway 35 for fuel. Tubular member 34 also defines a fuel inlet fitting (not referenced) for receiving fuel and a plurality of fuel injector sockets 36*a*, 36*b*, 36*c*, 36*d*, each of which are in fluid communication with fuel passageway 35 defined by tubular member 34. Each injector socket 36*a*, 36*b*, 36*c*, 36*d* receives a corresponding fuel injector (not shown). Fuel rail damper 10 is disposed within tubular member 34, and is centrally retained in place by damper holders 38*a* and 38*b*. Second end 16 of damper 10 protrudes through end 18 of the fuel rail so as to be open to atmospheric pressure. The joint between fuel rail end 18 and damper second end 16 is sealed in a fluid tight manner along periphery 40, such as, for example, by welding or brazing.

In use, fuel rail damper 10 is disposed within fuel rail 30 and attached to an internal combustion engine (not shown). The sequential operation of the fuel injectors, which are supplied with fuel by the fuel rail, create rapid fluctuations in pressure within the fuel rail and specifically within passageway 35. The pressure wave created by the pressure fluctuations impact one or both of walls 12*a*, 12*b* of fuel rail 10. The active portion of walls 12*a*, 12*b* is compliant and flex as a result of the impacting pressure wave, and thereby at least partially absorb the pressure wave. Further, the compliance of walls 12*a*, 12*b* reduce the velocity of the pressure wave, thereby slowing the wave and reducing the magnitude of the pressure pulsation.

Referring now to FIGS. 6–9, another embodiment of a fuel rail damper of the present invention is shown. Similar to fuel rail damper 10, fuel rail damper 110 is of one-piece construction. Further, fuel rail damper 110 is constructed from the same or similar materials and processes as discussed above in regard to fuel rail damper 10. However, unlike fuel rail damper 10, fuel rail damper 110 has both first end 114 and second end 116 open thereby defining open ends 117 of plenum 120.

Figure 10:
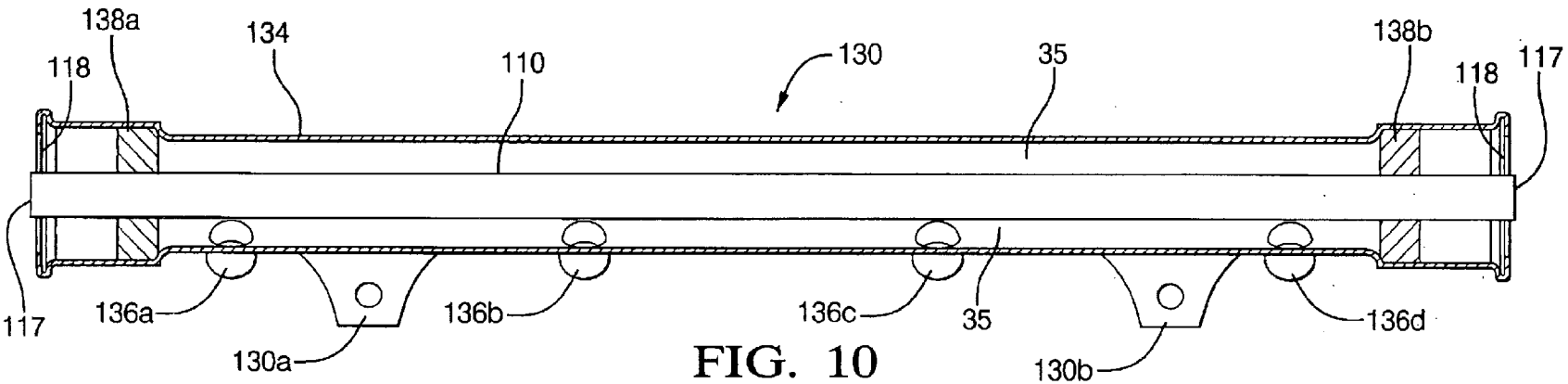
FIG. 10 is a cut-away view of a fuel rail having the fuel rail damper of FIG. 6 operably installed therein.

Fuel rail damper 110 includes a hollow member 112 having first end 114 and second end 116. Both of the ends are open 117 defining plenum 120 within hollow member 112. Hollow member 112, as shown, is substantially rectangular in cross-section. Hollow member 112 includes walls 112*a*, 112*b* and sides 112*c*, 112*d*. Walls 112*a*, 112*b* are relatively wide compared to sides 112*c*, 112*d*. At least one of walls 112*a*, 112*b* include active portion(s) 13 (one shown) of fuel rail damper 110. Active portion(s) 13 act to absorb and slow pressure pulsations occurring in the fuel rail 130 (FIG. 10). Hollow member 112 is constructed of, for example, stainless steel, low carbon steel, aluminum, or other suitable material that is substantially impervious to gasoline and/or fuel vapor.

Hollow member 112 is a one-piece fabricated member. Some possible ways of fabricating hollow member 112 include; a rolled weld process, a rolled weld and mandrel drawn process, or extrusion process, of flat stock or round tubing of the raw materials referred to above.

Referring now to FIG. 10, there is shown second embodiment of a fuel rail damper 110 of the present invention installed in fuel rail 130. Fuel rail 130 includes brackets 130*a*, 130*b* by which fuel rail 30 is operably installed, such as, for example, bolted to internal combustion engine (not shown). Fuel rail 130 further includes an elongate tubular member 134, which defines a passageway 35 for fuel. Tubular member 134 defines a fuel inlet fitting (not shown) for receiving fuel and a plurality of fuel injector sockets 136*a*, 136*b*, 136*c*, 136*d*, each of which are in fluid communication with fuel passageway 35 defined by tubular member 134. Each injector socket 136*a*, 136*b*, 136*c*, 136*d* receives a corresponding fuel injector (not shown). Fuel rail damper 110 is disposed within tubular member 134, and is centrally retained in place by damper holders 138*a* and 138*b*. Both ends 114 and 116 of damper 110 protrude through respective ends 118 of fuel rail 130 so as to be open to atmospheric pressure.

In use, fuel rail damper 110 is disposed within fuel rail 130 and attached to an internal combustion engine (not shown). The sequential operation of the fuel injectors, which are supplied with fuel by the fuel rail, create rapid fluctuations in pressure within the fuel rail. The pressure wave created by the pressure fluctuations impact one or both of walls 112*a*, 112*b* of fuel rail 110. The active portion of walls 112*a*, 112*b* is compliant and flex as a result of the impacting pressure wave, and thereby at least partially absorbs the pressure wave. Further, the compliance of walls 112*a*, 112*b* reduce the velocity of the pressure wave, thereby slowing the wave and reducing the magnitude of the pressure pulsation.

In the embodiments shown, dampers 10 and 110 are disclosed as generally elongate members. However, it is understood that the dampers can be alternately configured such as, for example, in the form of a sphere or an elliptical sphere.

In the embodiments shown, hollow members 12 and 112 are substantially rectangular in cross section. However, it is to be understood that hollow members 12 and 112 can be alternately configured, such as, for example, with an oval or generally triangular cross section having one or any number of active portions.

In the embodiment shown, first end 14 may be stamped flat and extend in a generally parallel manner relative to hollow members 12. However, it is to be understood that first end 14 can be alternately configured, such as, for example, stamped flat and then folded over and back in a direction toward one of faces 12*a*, 12*b* or simply capped (not shown) in a fluid tight manner.

In the embodiments shown, ends 17, 117 are shown as being uncapped after being assembled into the fuel rail. It is understood that the ends may be left uncapped or may be closed after assembly using any number of methods including capping or welding of the ends closed.

In the embodiments shown (FIGS. 5 and 10), damper holders 38*b*, 138*a* and 138*b* are disclosed as being separate from fuel rail ends 18, 118. It is understood that the holders and ends may be combined into one feature allowing the one feature to both centrally orient the damper and seal the end of the fuel rail.

While this invention has been described as having preferred designs, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed is:

1. A fuel rail damper, comprising:

a hollow member having a first end and a second end, and at least one active portion, both of said first and second ends being open to the atmospheric pressure, thereby defining a chamber in conjunction with said at least one active portion.

2. The fuel rail damper of claim 1, wherein said hollow member comprises a one piece hollow member.

3. A fuel rail, comprising:

a tubular member defining a passageway for fluid, at least one injector socket defined by said tubular member, each of said at least one injector socket in fluid communication with said passageway, said tubular member configured for being fluidly connected to a fuel supply; and a fuel rail damper including a hollow member disposed within said passageway, said hollow member having at least one wall and at least one active portion, said hollow member defining a chamber in conjunction with said at least one active portion, said chamber being open to atmospheric pressure.

4. A fuel rail comprising:

a tubular member defining a passageway for fluid, at least one injector socket defined by said tubular member, each of said at least one injector socket in fluid communication with said passageway, said tubular member configured for being fluidly connected to a fuel supply; and a fuel rail damper including a hollow member disposed within said passageway, said hollow member having a first end and a second end, and at least one active portion, at least one of said first and second ends being open to atmospheric pressure, thereby defining a chamber in conjunction with said at least one active portion.

5. The fuel rail of claim 4, wherein said hollow member comprises a one piece hollow member.

6. The fuel rail of claim 4, further comprising both of said first and second ends being open to the atmosphere.

7. The fuel rail damper of claim 4, further comprising one of said first and second ends being sealed in an air tight manner.

8. The fuel rail damper of claim 4, further comprising one of said first and second ends being closed.

9. A method of making a fuel rail comprising:

forming a tubular member defining a passageway for fluid, with at least one injector socket defined by said tubular member, each of said at least one injector socket in fluid communication with said passageway, said tubular member configured for being fluidly connected to a fuel supply;

forming a fuel rail damper including a hollow member disposed within said passageway, said hollow member having at least one wall and at least one active portion, said hollow member being open to atmospheric pressure, at least during assembly, thereby defining a chamber in conjunction with said at least one active portion.

10. A method of making a fuel rail comprising:

forming a tubular member defining a passageway for fluid, with at least one injector socket defined by said tubular member, each of said at least one injector socket in fluid communication with said passageway, said tubular member configured for being fluidly connected to a fuel supply;

forming a fuel rail damper including a hollow member disposed within said passageway, said hollow member having a first end and a second end, and at least one active portion, at least one of said first and second ends being open to atmospheric pressure, at least during assembly, thereby defining a chamber in conjunction with said at least one active portion.

11. The method of making a fuel rail of claim 10, further comprising: closing one of said first and second ends after assembly.

12. The method of making a fuel rail of claim 10, further comprising: closing both of said first and second ends after assembly.

13. The method of making a fuel rail of claim 10, further comprising: sealing one of said first and second ends in an air tight manner after assembly.

14. The method of making a fuel rail of claim 10, further comprising: sealing both of said first and second ends in an air tight manner after assembly.

15. A fuel rail comprising:

a tubular member defining a passageway for fluid, at least one injector socket defined by said tubular member, each of said at least one injector socket in fluid communication with said passageway, said tubular member configured for being fluidly connected to a fuel supply; and a fuel rail damper including a hollow member disposed within said passageway, said hollow member having a first end and a second end, and at least one active portion, both of said first and second ends being open to the atmosphere, thereby defining a chamber in conjunction with said at least one active portion.

* * * * *